US006295041B1

(12) United States Patent
Leung et al.

(10) Patent No.: US 6,295,041 B1
(45) **Date of Patent: *Sep. 25, 2001**

(54) INCREASING THE NUMBER OF COLORS OUTPUT BY AN ACTIVE LIQUID CRYSTAL DISPLAY

(75) Inventors: Charles Leung; Keith Lee, both of Markham (CA)

(73) Assignee: ATI Technologies, Inc. (CA)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/811,866

(22) Filed: Mar. 5, 1997

(51) Int. Cl.[7] ..... G09G 3/36

(52) U.S. Cl. ..... 345/89; 345/147; 345/149; 345/88; 345/199

(58) Field of Search ..... 345/147, 148, 345/149, 88, 89, 199

(56) References Cited

U.S. PATENT DOCUMENTS 4,827,255 * 5/1989 Ishii ..... 345/148
5,023,603 * 6/1991 Wakimoto et al. ..... 345/148
5,065,149 * 11/1991 Marsh et al. ..... 345/148
5,122,783 * 6/1992 Bassetti, Jr. ..... 345/88
5,272,471 * 12/1993 Asada et al. ..... 345/149
5,321,418 * 6/1994 Leroux ..... 345/147
5,389,948 * 2/1995 Liu ..... 345/148
5,450,098 * 9/1995 Oz ..... 345/199
5,548,305 * 8/1996 Rupel ..... 345/149
5,552,800 * 9/1996 Uchikoga et al. ..... 345/149
5,583,530 * 12/1996 Mano et al. ..... 345/89
5,629,720 * 5/1997 Cherry et al. ..... 345/199
5,648,796 * 7/1997 Boursier et al. ..... 345/149
5,673,065 * 9/1997 DeLeeuw ..... 345/199
5,691,745 * 11/1997 Mital ..... 345/148
5,774,101 * 6/1998 Hirai et al. ..... 345/89
5,818,405 * 10/1998 Eglit et al. ..... 345/88
5,905,490 * 5/1999 Shu et al. ..... 345/199
5,926,647 * 7/1999 Adams et al. ..... 345/199

* cited by examiner

*Primary Examiner*—Steven Saras
*Assistant Examiner*—Alecia D. Nelson
(74) *Attorney, Agent, or Firm*—Vedder, Price, Kaufman & Kammholz

(57) ABSTRACT

A technique increases the number of colors output by an active color display by providing an increased number of grey levels for each pixel component. An M×N matrix pattern of pixel components is generated having a ratio of pixel components at a particular color level to pixel components at a different color level to achieve a particular grey level, where M and N are greater or equal to two. The M×N matrix pattern is repeated for X frames, and at least one pixel component is at the particular color level in each frame. At the end of the Nth frame, the matrix pattern from frame zero is repeated.

3 Claims, 3 Drawing Sheets

INCREASING THE NUMBER OF COLORS OUTPUT BY AN ACTIVE LIQUID CRYSTAL DISPLAY

BACKGROUND OF THE INVENTION

The invention relates to a technique and device for increasing the number of colors output by an active liquid crystal display.

Active color liquid crystal (LCD) displays, also known as Thin Field Transistor (TFT) panel displays, are commonly used in laptop computers to present information to a user. Active color LCD panels and color cathode-ray tube (CRT) monitors both have a color resolution that depends upon the number of pixels in the display. Typical active color LCD display resolutions are 640 columns of pixels by 480 rows of pixels (640×480), 800×600 pixels and up to 1280×1024 pixels. However, a CRT monitor uses analog data to form images on its screen, and an active color LCD panel display uses digital data.

Each pixel in the active color LCD display consists of three primary color components: red, green and blue. The four common types of active color LCD displays are known as 3-3-3, 4-4-4, 6-6-6 and 8-8-8 TFT panels. The numbers indicate the number of bits of data that must be supplied to each of the primary color components of a pixel in the display. For example, in a 3-3-3 TFT panel, 3 bits of data are required for each of the three pixel components, and thus each pixel component is capable of $2^3$ or eight levels of color. Consequently, the total color output of a pixel in the 3-3-3 panel equals 8×8×8 which is 512 colors.

New data must be supplied to the pixels of an active color LCD display periodically to refresh the image shown on the screen, and such time segments are known as frames. The required number of bits of data per pixel color component is typically supplied every 1/60th of a second, which corresponds to a refresh rate of sixty frames per second.

A technique known as frame modulation, which entails switching certain pixel color components ON and OFF over certain areas on the screen for a number of frames of the refresh cycle, is known for increasing the number of grey levels and thus the number of colors that can be shown on a color display. However, frame modulation has not been used to increase the number of colors output by an active LCD display because the pixel components change so quickly that using frame pattern modulation could result in noticeable flicker. A need exists, therefore, not only for increasing the number of colors that may be displayed by an active color LCD display, but also for improving the overall quality of the color and for minimizing any flicker of the screen which can be detected by the human eye.

SUMMARY OF THE INVENTION

The invention increases the number of colors output by an active liquid crystal display by providing an increased number of grey levels. In particular, the number of colors that may be displayed by 3-3-3, 4-4-4 and 6-6-6 active liquid crystal displays are increased.

In general, the invention features generating a M×N matrix pattern of pixel components on the display having a ratio of pixel components that are at a particular color level to pixel components at a different color level to achieve a particular grey level, where M and N are greater or equal to two. The M×N matrix pattern is produced for X frames, and at least one pixel component is at the particular color level in each frame.

Preferred embodiments include the following features. In the M×N matrix the same number of pixel components are at the particular color level in each frame but in different locations. In addition, at least one of the pixel components is at the particular color level in each row and in each column. Further, over a cycle of X frames, each pixel component is at the particular color level for "Y" amount of times, wherein "Y" is the number of pixel components in each row and column that are at the particular color level in any one frame.

A preferred embodiment includes M×N matrix patterns to produce three grey levels. In particular, 3×3 patterns having one pixel component at the color level in each row or column to generate grey level 4, and having three pixel components at the color level in each row or column to generate grey level 10, are utilized. In addition, a 2×2 matrix pattern having one pixel component at the color level in each row or column to generate grey level 7 is used.

In a further aspect of the invention, a grey level generator circuit is used to produce the grey level patterns. In particular, a memory stores an M×N matrix pattern. A frame counter for counting to X frames, a column counter for counting to N, and a row counter for counting to M are provided. The row counter is pre-loaded at the start of each frame with a value for a pixel component based on the data stored in memory. A comparator generates output signals to indicate whether pixel components should be at a particular color level or at a different color level depending on the frame and their location in a row or column.

In another aspect of the invention, an apparatus for increasing the color output of an active color LCD display includes a frame buffer for providing selection signals and LCD display signals. A plurality of grey level generators, a selector circuit and a subtract circuit are also provided. The selector circuit selects one of the grey level generators based on the frame buffer selection signals, and generates a grey level output signal. The subtract circuit processes the grey level output signal from the selector circuit with the LCD display signals from the frame buffer to provide an output signal for the active color LCD display. In addition, each grey level generator includes a memory for storing M×N matrix pattern data.

DESCRIPTION OF THE PREFERRED EMBODIMENTS

Figure 1:
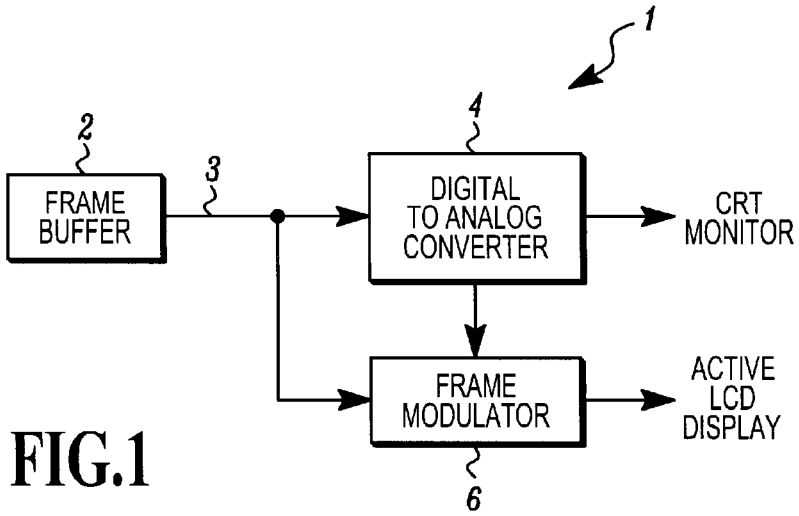
FIG. 1 is a simplified, partial block diagram of several of the components of a graphics controller semiconductor chip for controlling display colors.

FIG. 1 is a simplified, partial block diagram 1 of components of a graphics controller semiconductor chip for generating the signals used to control the screen colors of an active color LCD display or a cathode-ray tube (CRT) display. A frame buffer 2 stores the data required for each color component of each pixel of a display screen. The data provided depends on the color to be displayed at a particular location on the screen and at a particular time. The output signal 3 of the frame buffer 2 is received by a digital-to-analog converter 4 for producing analog signals for use by a CRT monitor, and by a frame modulator 6 for producing digital signals for use by an active color LCD display screen. The frame buffer 2 stores 24 bits of data for each pixel.

For a typical screen refresh rate of 60 frames per second, and assuming a 3-3-3 active color LCD display, three bits of data per pixel component are required to refresh the screen every 1/60th of a second. The refresh rate is sixty frames per second.

Frame modulation for an n-n-n active color LCD display (where n can be 3, 4 or 6) involves providing extra grey levels between the color component brightness levels already capable of being utilized. It has been discovered that if a limited number of additional grey levels are added between the existing color levels, then screen flicker is minimized so that the color shown by the active LCD display is acceptable to the human eye. For example, in a 3-3-3 active color LCD display, each pixel component is capable of $2^3$ or eight color brightness levels. Therefore, a graphics controller sends three bits of data (0,0,0 to 1,1,1 binary) for each pixel component in each frame to the active color LCD display depending on which of the eight color levels (L) is required. For each value L, the present frame modulation technique makes it possible to produce four grey levels to increase the total number of colors that can be shown. Therefore, using such a technique with a 3-3-3 active color LCD display, the number of colors that can be produced by each color component increases from eight to thirty-two, and the total color output increases from 512 to 32,768 colors. Consequently, the 3-3-3 active color LCD display would have a color output comparable to a 5-5-5 active color LCD display. The technique can be applied to all active color LCD matrix or TFT panel types except 8-8-8 type panels, because such panels already use all 24-bits of data that the frame buffer in the graphics controller can provide.

Figure 2:
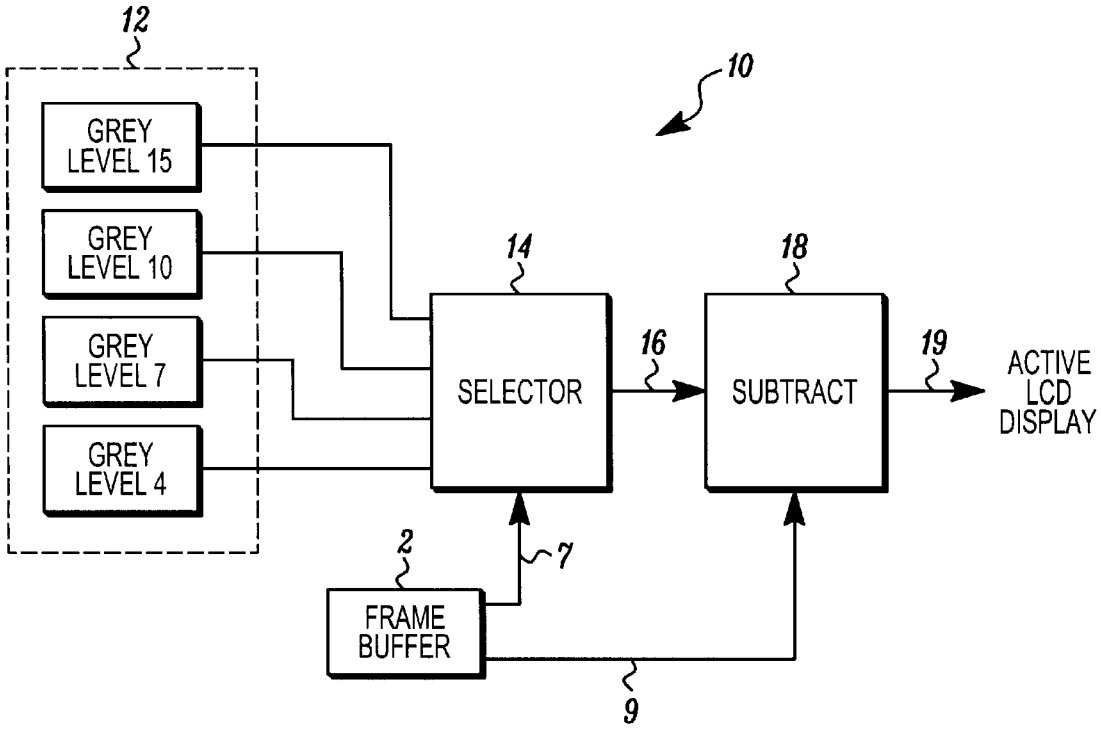
FIG. 2 is a simplified block diagram illustrating an implementation of the invention for a 3-3-3 active color LCD display.

FIG. 2 is a simplified block diagram 10 illustrating an implementation of a frame modulation technique for increasing the color output of a 3-3-3 active color LCD display. Four grey level pattern generators for one color component of a pixel are shown within dotted line 12, and are labelled grey level 15, grey level 10, grey level 7 and grey level 4. Each grey level pattern generator produces a unique matrix pattern which can be selected by the selector 14 to output a particular grey level signal 16 to a subtract circuit 18. In particular, the frame buffer 2 stores 8-bits of data per color component, so two bits (bits 4 and 3) are input on line 7 to the selector 14 to choose one of the four grey level pattern generators. At the same time, three bits from the frame buffer (bits 7 to 5) are input on line 9 for a particular color level L to the subtract circuit 18. If the output line 16 of the selector 14 is one, then the three bits on line 9 are output to the active color LCD panel. However, if the output of line 16 of the selector 14 is zero, then a subtraction function is carried out on the three bits from the frame buffer so that the next lower color level (L minus one) is output to the LCD panel. If the three bits (7 to 5) all happen to be zero indicating that the color component is at grey level zero or OFF, then the subtractor circuit sends zeros to the LCD panel regardless of the output from the selector 14.

In the case of a 4-4-4 active color LCD display, the data that is fed to the selector circuit 14 from the frame buffer is bits 3 to 2, and the data from the frame buffer used by the subtract circuit is bits 7 to 4. In the case of a 6-6-6 active color LCD display, the data from the frame buffer used by the selector circuit 14 is bits 1 to 0, and the frame buffer data used by the subtract circuit is bits 7 to 2.

Figure 3A:
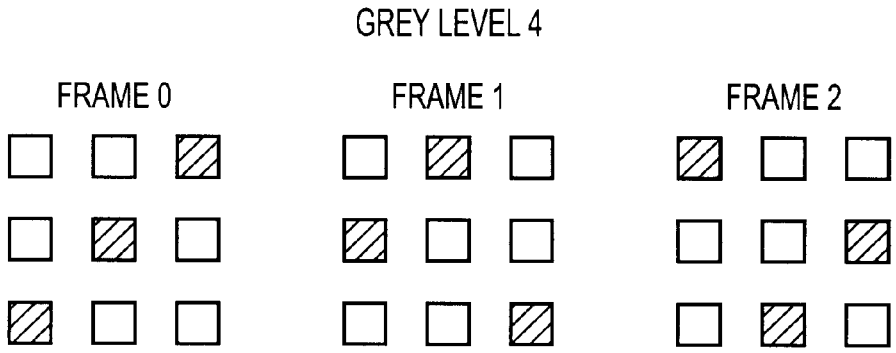
FIGS. 3A–3C illustrate preferred embodiments of M×N matrix patterns for generating grey levels according to the invention.
Figure 3B:
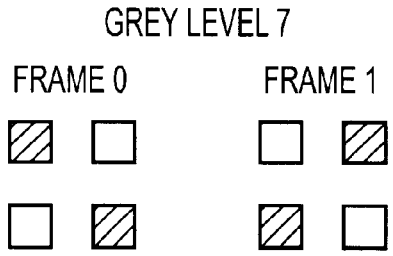
Figure 3C:
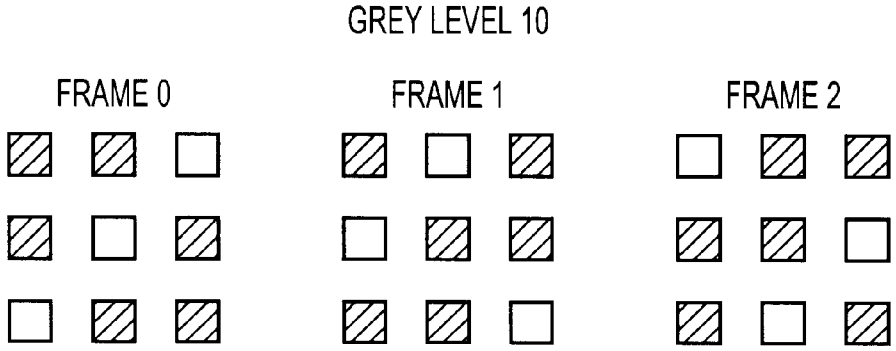

FIGS. 3A–3C depict preferred embodiments of M×N matrix patterns for use in generating grey levels four, seven and ten, respectively, for one color component of the pixels of an active color LCD display. It should be understood, however, that matrix patterns of different sizes and shapes than those shown in FIGS. 3A–3C are contemplated. For example, the matrices could be rectangular instead of square. A black dot indicates that a color component of a pixel should be ON at color level L at that coordinate or location in the matrix, and a blank or white dot indicates that the color component of a pixel at that coordinate should be ON at a different color level. In a preferred embodiment, a white dot in the matrix indicates that a pixel component is ON at color level L−1, or a lower or dimmer color level. However, the blank dot could also correspond to that pixel component being ON at a higher color level L+1.

The same matrix patterns shown in FIGS. 3A–3C are used for each of the three color components of a pixel to generate intermediate grey levels, and the patterns repeat in row, column and frame cycle. Grey level fifteen is not shown, because it corresponds to the case wherein the graphics controller sends the color level signal L at all times, meaning that the pixel color components are all ON at that color level.

FIG. 3A depicts a 3×3 pixel matrix pattern which changes over the course of 3 frames, which is used to produce grey level 4 for a color component on the active color LCD display. The 3×3 matrix pattern can be regarded as the output of a four-dimensional function pertaining to a component of each pixel on the screen. The inputs to the function are the x and y coordinates of the pixels, the particular grey level required, and the current frame number which changes with time. For example, if an entire 640×480 pixel active color LCD display is to be grey level 4 for a pixel component at a color level L, then the 3×3 matrix pattern of frame zero in FIG. 3A would be replicated to encompass the pixel components over the entire screen area, and then frame one is used, and so forth. As the screen continues to be refreshed over sixty frames, frames zero to two are repeated if grey level 4 is still required.

The matrix pattern of FIGS. 3A–3C can be stored in a look-up table in memory, and utilized over any particular section or sections of the active color LCD display screen for any of the color levels as needed. For example, portions of an active display LCD screen requiring a certain color may be supplied with the frame modulation patterns of FIG. 3A in the same manner as described above, wherein the frame modulation pattern is repeated in the horizontal and vertical directions, at the same time that other portions of the screen are at different color levels.

Referring again to FIG. 3A, one pixel color component is ON at color level L in each of the three rows and columns for each of the three frames, and the other pixel components are at color level L−1. Each frame is visible on the display screen for 1/60th of a second (assuming a refresh rate of 60 frames per second). As shown, each pixel component in the 3×3 matrix pattern is at color level L once every 3 frames over the cycle. Care has been taken to ensure that the pixel components that are at level L are evenly distributed in the matrix from frame to frame. The distribution of pixel components that are at level L to those that are at level L−1 ensures that an observer will see an even color output for that grey level on the active color LCD screen.

Referring to FIG. 3C, the 3×3 pattern matrix for grey level 10 is shown, which is the complement of the 3×3 pattern matrix for grey level 4. Consequently, one pixel component is at color level L−1 in each of the three rows and columns for each of the three frames.

FIG. 3B depicts the 2×2 matrix pattern generated for grey level 7. Again, as shown the pixel components that are at color level L with regard to those that are at color level L−1 will be evenly distributed for all the frames.

Therefore, the described technique produces an M×N matrix pattern having a ratio of pixel components that are at color level L to those at L−1 to achieve a particular color grey level, wherein N is greater or equal to two. The size of the matrix dictates the number of frames or repetitions that are displayed which results in an even color distribution. Thus, for N frames, a matrix is produced of the same size having the same number of color components at color level L in each row and column but in different locations from previous frames. At the end of the Nth frame, the first matrix pattern is repeated.

Features of the matrix patterns chosen for the different grey levels include that at least one of the pixel components is at color level L in each row and in each column for each frame, and that over the course of N frames each pixel component is at color level L for "x" amount of times, wherein "x" equals that number of pixels in each row or column at color level L in any particular frame. These features result in a grey level color distribution that provides an even appearance and reduces any flicker of the screen for an observer of the active color LCD display.

Figure 4:
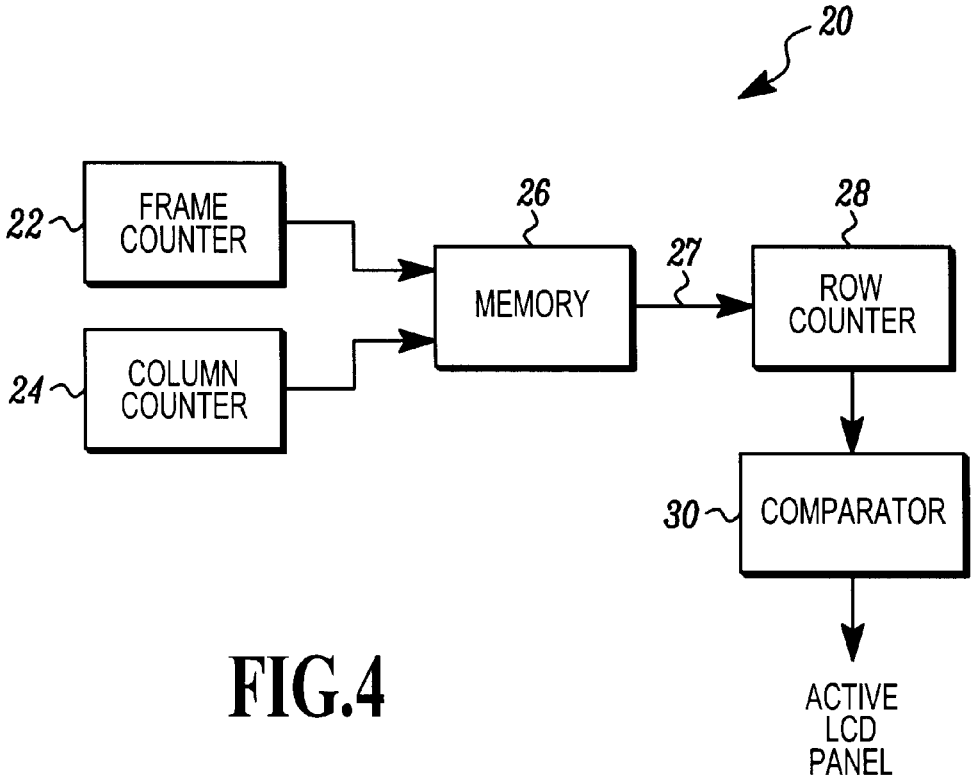
FIG. 4 is a simplified block diagram of a grey level generator circuit.

FIG. 4 is a simplified block diagram 20 of the components of a grey level generator. A frame counter 22 counts the frame number, and a column counter 24 counts the pixels in a column. The frame counter 22 and column counter 24 are connected to a memory 26 which contains a look-up table of values for a particular grey level. A row counter 28 has an output connected to a comparator 30, and is pre-loaded with an initial value for a pixel component from the look-up table in the memory 26, which is based on the current frame number and column location. The comparator 30 checks the value received from the row counter 28, and then generates a signal indicating whether or not a particular color component of a pixel in a matrix pattern should be turned ON for that grey level.

For example, if the grey level 4 as shown in FIG. 3A is to be generated, the frame counter of FIG. 4 counts continuously from zero to two for each frame as the screen is being refreshed. Similarly, column counter 24 counts from zero to two and resets at the first line of each frame. The row counter counts down the rows from two to zero during data generation for the display, and is pre-loaded with an initial value from the memory 26 which includes the current frame number and the current column position. The comparator then checks the value of the row counter and, if required, generates a signal to turn ON a color component of a pixel for that coordinate. Therefore, referring to FIG. 3A, for frame 0 a signal would be generated to indicate that a pixel component should be ON at color level L at row one, column zero (the leftmost column in the matrix pattern of FIG. 3A being two, and the rightmost column being zero). This procedure continues for the other rows and columns.

A separate grey level generator 20 of FIG. 4 may be provided for each grey level, except the counters count to different values N which depend on the matrix dimension for a particular grey level. For grey levels that are complements of one another, such as grey levels 4 and 10, the same grey level generator circuit may be used but the complement of the comparator output is used to indicate whether a pixel component at a particular color level should be ON or at the next dimmer color level for a particular coordinate and frame.

Other embodiments are within the scope of the following claims. For example, in other embodiments different dimension matrices may be used having more or less pixel color components at the color level per frame. In addition, the disclosed technique may be adapted for use by other digital output devices.

What is claimed is:

1. A method to reducing flicker while increasing number of colors output by an active color LCD display, the method comprising:

receiving data for a particular color component;

utilizing a first portion of the data for selecting one of a plurality of gray level pattern generators, where each of the plurality of gray level pattern generators includes:

a corresponding plurality of matrix patterns, where each matrix pattern of the corresponding plurality of matrix patterns is associated with a frame of a set of frames and is a 3×3 matrix, and each matrix pattern includes:

a first gray level indicator, a second gray level indicator, a plurality of rows and a plurality of columns, wherein each row and column of the plurality of rows and columns have the same number of first gray level indicators as each other row and column in the plurality of rows and the plurality of columns;

utilizing a second portion of the data and the corresponding plurality of matrix patterns to produce a color component display output for the set of frames;

wherein the plurality of gray level pattern generators further comprise a gray level 10 generator, a gray level 7 generator, and a gray level 4 generator.

2. An apparatus for increasing the number of colors output by an active color LCD display, comprising:

a frame buffer that stores color component data;

a set of generator circuits, the set consisting of a gray level 15 generator circuit, a gray level 10 generator circuit, a gray level 7 generator circuit, and a gray level 4 generator, wherein each generator circuit of the set of generator circuits includes a plurality of matrix patterns, wherein each matrix pattern of the plurality of matrix patterns is associated with a corresponding frame of a set of frames, wherein a matrix pattern of the plurality of matrix patterns includes a first grey level indicator and a second grey level indicator, wherein the matrix pattern has a same number of pixels having the first gray level indicator in each column and each row of the matrix pattern as each other matrix pattern of the plurality of matrix patterns;

a selector circuit operably coupled to receive a first portion of the color component data and to select a generator circuit of the set of generator circuits based on the first portion, wherein the selector circuit receives, on a pixel-by-pixel and frame-by-frame basis, the first or second grey level indicator from the selected generator circuit; and a subtract circuit operably coupled to receive the first or second grey level indicator from the selector circuit and to receive a second portion of the color component data from the frame buffer, wherein the subtract circuit passes, as a digital output signal, the second portion when the first grey level indicator is received for a particular pixel and alters the second portion by a given value when the second grey level indicator is received for the particular pixel.

3. The apparatus of claim 2, wherein each grey level generator circuit comprises a memory for storing M×N matrix pattern data.

* * * * *